United States Patent [19]

Leroy

[11] Patent Number: 4,647,356

[45] Date of Patent: Mar. 3, 1987

[54] CATHODE ROD COMPRISING A METAL SOLE, FOR HALL-HEROULT ELECTROLYSIS CELLS

[75] Inventor: Michel Leroy, Saint-Jean-de-Maurienne, France

[73] Assignee: Aluminium Pechiney, Paris, France

[21] Appl. No.: 694,381

[22] PCT Filed: May 14, 1984

[86] PCT No.: PCT/FR84/00129

§ 371 Date: Dec. 20, 1984

§ 102(e) Date: Dec. 20, 1984

[87] PCT Pub. No.: WO84/04547

PCT Pub. Date: Nov. 22, 1984

[30] Foreign Application Priority Data

May 16, 1983 [FR] France ..... 83 08334
Mar. 2, 1984 [FR] France ..... 84 03863

[51] Int. Cl.[4] ..... C25C 3/08; C25C 3/16

[52] U.S. Cl. ..... 204/243 R; 204/289; 204/294; 204/290 R

[58] Field of Search ..... 204/67, 243 R–247, 204/289, 294, 290 R

[56] References Cited

U.S. PATENT DOCUMENTS 2,528,905 11/1950 Ollivier et al. ..... 204/243 R
2,593,751 4/1952 Grolee ..... 204/243 R
2,846,388 8/1958 Morel ..... 204/243 R
3,551,319 12/1970 Elliot ..... 204/289 X
4,488,955 12/1984 Bertaud et al. ..... 204/243 R

*Primary Examiner*—Donald R. Valentine
*Attorney, Agent, or Firm*—Dennison, Meserole, Pollack & Scheiner

[57] ABSTRACT

The invention relates to a cathode rod permitting extraction of the current from a cell for the production of aluminum by electrolysis according to the Hall-Heroult process, which is sealed in at least one groove which is open at the base of each of the carbonated blocks 1 forming the cathode of the electrolysis cell.

According to the invention, the cathode rod 2 is extended by a metal sole 5 in electrical contact with the base of the carbonated blocks 1 over at least 20% of the total surface area of this base. The sole 5 is constituted by a metal sheet which is at least 4 mm thick and preferably at least 10 mm thick and is soldered to the cathode rod 2 before the carbonated block 1 is positioned in the cell.

To prevent infiltration of electrolyte into the subcathode space, the lower face of the sole 5 is placed in a superimposed relationship and in electrical contact with a thick, continuous metal screen 26 arranged at the top of the thermally insulating lining.

23 Claims, 21 Drawing Figures

CATHODE ROD COMPRISING A METAL SOLE, FOR HALL-HEROULT ELECTROLYSIS CELLS

The invention relates to the construction of electrolysis cells for the production of aluminium by the Hall-Heroult process. It relates, more particularly, to a cathode rod comprising a metal sole intended to increase the cross-section for passage and to make the distribution of the cathode current uniform.

DESCRIPTION OF THE PRIOR ART

The cathode of a Hall-Heroult electrolysis cell is formed by juxtaposing a group of carbonated blocks provided on their bottom face with 1 (or sometimes 2) open grooves in which there are fixed, generally by pouring cast iron, some steel rods of square, rectangular or circular cross-section to which there are connected the conductors joining the successive cells forming a series.

The steel rods used for extracting the cathode current thus offer a limited contact surface with the carbon causing a considerable drop in voltage at the carbon/-cast iron interface.

To reduce this voltage drop, it is also known to increase the cross-section of the steel rod, at least in the sealed zone in the carbon, while maintaining a normal or reduced cross-section when passing through the external portion of cell insulation so as to avoid excessive thermal leakages.

However, such action is necessarily limited as the thickness of carbon on the flanks of the groove must be sufficient mechanically to resist the stresses due to thermal expansion of the cathode rod and of its sealing means when the cell is set into operation.

OBJECT OF THE INVENTION

The object of the present invention is substantially to increase (by more than 10%) the cross-section of steel available for removing the cathode current, and the contact surface between the carbon and the cathode conductors. It involves providing each cathode rod with a metal sole in electrical contact with the horizontal base of each carbonated block, the sole being welded to the cathode rod to permit the passage of the electric current. Moreover, a continuous steel screen may he arranged beneath the sole in electrical contact with the sole, thus preventing infiltration of liquid aluminium and molten cryolite and substantially increasing the service life of the electrolysis cell.

FIG. 1 relates to the prior art.

FIGS. 2 to 15 illustrate the implementation of the invention.

All the figures are shown in a vertical section.

Figure 1:
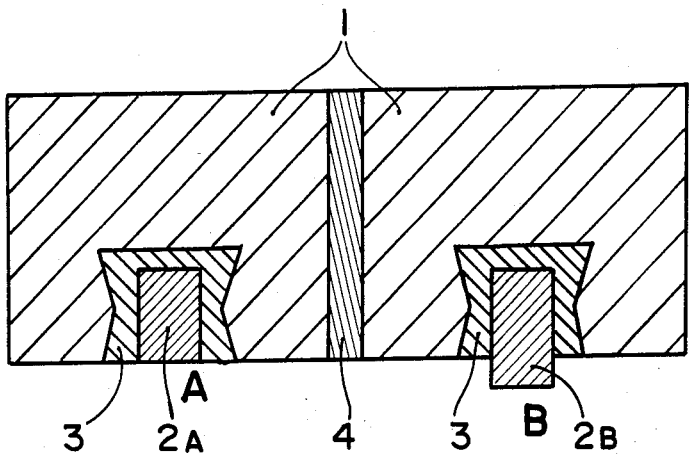
FIG. 1 shows the conventional arrangement of a carbonated cathode block 1 in which the rod 2A is sealed by cast iron 3.

In this case, the rod is flush with the base of the carbonated block. In the right-hand portion of FIG. 1, the rod 2B in an alternative embodiment can extend, more or less, beyond the base plane of the carbonated block 3. The successive cathode blocks are usually assembled by a gasket 4 made of carbonated paste.

Figure 2:
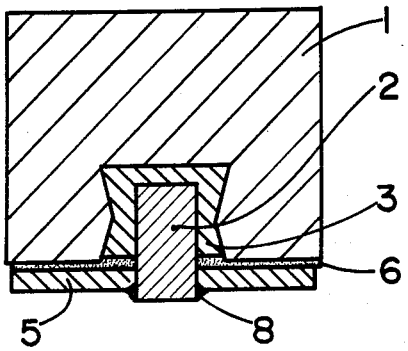

FIG. 2 shows a first embodiment of the invention. Two thick sheets of mild steel 5 connected to the base of the carbonated block 1 by a layer of electrically conductive elastic material 6 have been welded to the cathode rod.

Figure 2A:
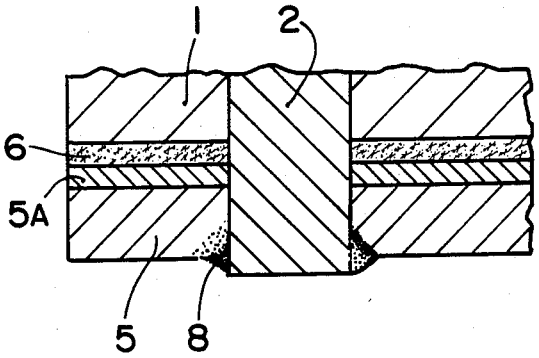

In a variation (FIG. 2A), the steel sole 5 can be formed by a steel-copper colaminate, the copper face 5A being in contact either directly with the carbonated block 1 or via the elastic conductive layer 6. The thickness of the copper layer 5A should preferably exceed a minimum value which can be estimated as about 5% of the steel layer, corresponding to the solubility of copper in steel at 900°–950° C. so that the entire copper layer does not disappear by diffusion in the solid state into the steel.

The malleability of hot copper facilitates the establishment of good contact with the cathode block and, if necessary, can partially compensate the deformations of the steel sole.

Moreover, since copper is a much better conductor of electricity than steel, a significant reduction in the voltage drop takes place in the cathode collectors.

FIG. 3 shows the four stages, 3*a*, 3*b*, 3*c*, 3*d*, in the procedure used for constructing the assembly in FIG. 2.

Figure 3A:
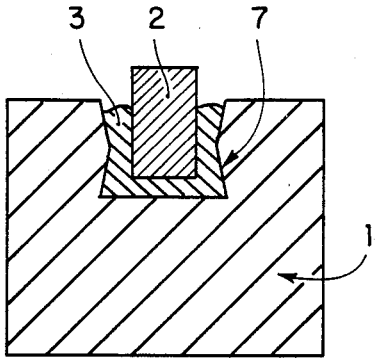

FIG. 3*a* shows the first stage:

After the carbon block 1 has been turned so that the groove 7 ls upper-most, the cathode rod 2 is sealed by pouring cast iron 3.

Figure 3B:
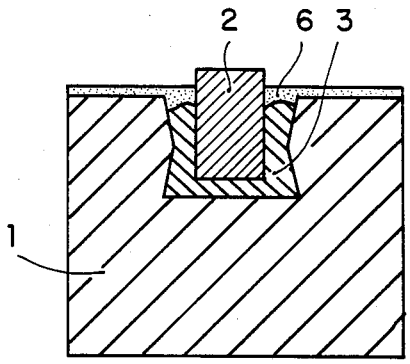

FIG. 3*b* shows the second stage:

After sealing the cathode rod 2, an electrically conductive elastic layer 6 is placed on the upper face of the turned block. It is advantageous to use a carbon or graphite felt, or again a laminated graphite film or again a complex formed by sticking a strip of carbon or graphite felt to a strip of laminated graphite.

As an example, RVG graphite felts or "PAPYEX" (trade marks registered by the company "Le Carbone-Lorraine") can be used.

Figure 3C:
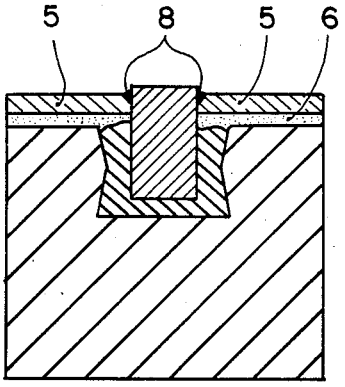

FIG. 3*c* shows the third stage:

The sole 5 constituted by two thick steel sheets is placed on the elastic connecting layer 6 and is applied vigorously by pressing against the elastic connecting layer 6.

Wires of solder 8 which are preferably continuous can be produced for connecting the thick sheets to the cathode rod. A steel sole which is connected electrically to the cathode rod is thus produced. The sole is at least 4 mm and preferably at least 10 mm and generally approximately 10 to 15 mm thick. The cross-sectional area of the cathode rod can be, for example, 160×120 mm.

Figure 3D:
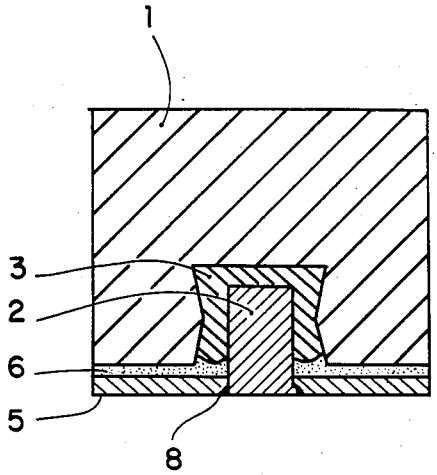

FIG. 3*d* shows the carbonated cathode block placed in the normal position by turning.

Figure 4:
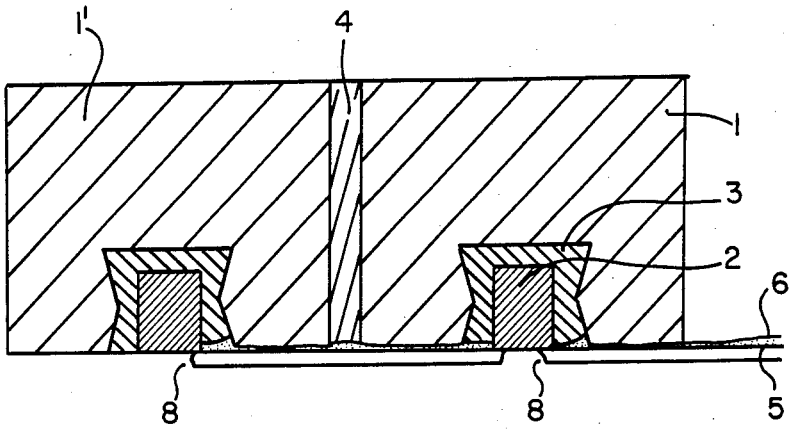

FIG. 4 shows a variation of the invention in which the steel sole is straddled by two carbonated cathode blocks, in electrical contact with these blocks.

Figure 5:
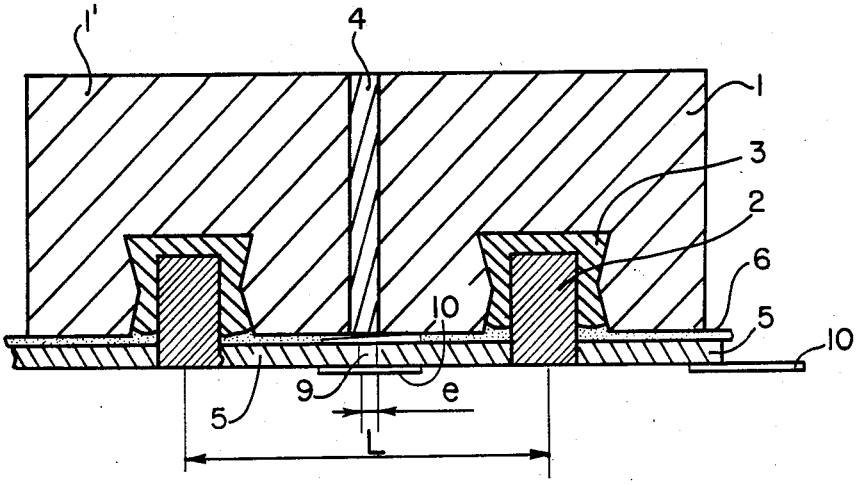

FIG. 5 shows that, at the moment of assembly, it is preferable to provide a slight clearance between the soles 5 of two adjacent blocks 1 and 1' so that, when the normal operating temperature is reached, and owing to the greater expansion of the steel sole than of the carbonated block, the edges of the two adjacent soles 5 and 5' are in contact agaih with just sufficient pressure to weld these edges to each other without this pressure being great enough to cause deformation of the soles which would impair the electrical contact between carbonated blocks and steel soles.

Figure 5A:
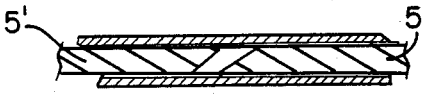
Figure 5B:
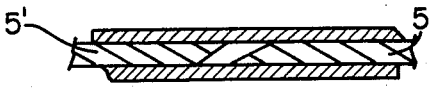

The opposing ends of the two adjacent soles 5 and 5' can be perpendicular to the plane of the sole and parallel to each other as shown in the figure or they can be bevel-edged (FIGS. 5*a*, 5*b*).

The planes of the bevels at 5 and 5' may or may not be parallel to each other (5A or 5B respectively).

To prevent powdered products originating in the laying bed 11 from penetrating in the clearance 9 between the two sheets 5 and 5', it is possible to interpose a strip of thin sheet 10 acting as a gasket. This sheet also prevents the carbonated paste filling the gasket 4 from flowing into the space 9 during the first heating operation.

The size of the clearance 9 required for assembly or installation depends on the exact nature of the carbonated block which may be based on anthracite, or semi-graphite or semi-graphitized or graphite, and on the exact size of the blocks and the soles, and on the nature and thickness of the gasket between carbonated blocks which may be blocks stuck to each other or separated by a small gasket 4 of brasque paste. This clearance will generally be defined by a e/L ratio of approximately 1 to 2%.

Figure 6:
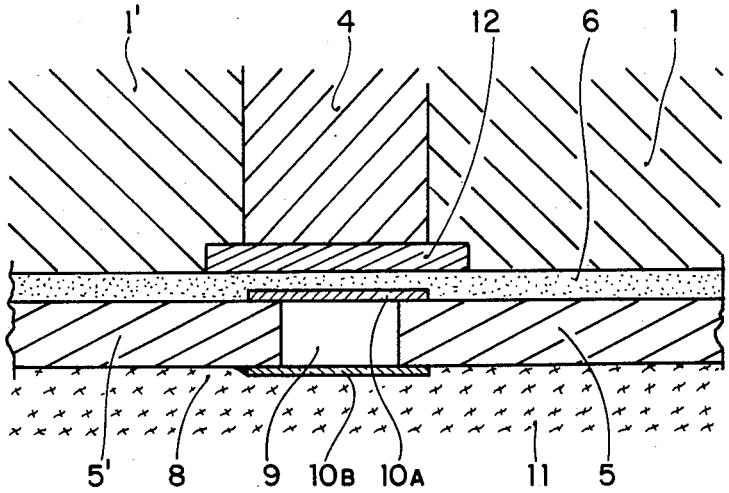

FIG. 6 shows an assembly detail of the sealing strips 10. The upper strip 10A is welded, for example on the sheet 5 and the lower strip 10B is welded on the sheet 5' so that they can slide freely and adopt their final position during the first heating operation.

Moreover, and providing that a suitable groove is provided in the cathode blocks 1, a graphite member of low porosity 12 which improves the seal of the gasket 4 and reduces the risk of infiltration by molten cryolite during start up of the electrolysis cell can be placed at the bottom of the gasket 4.

Figure 7:
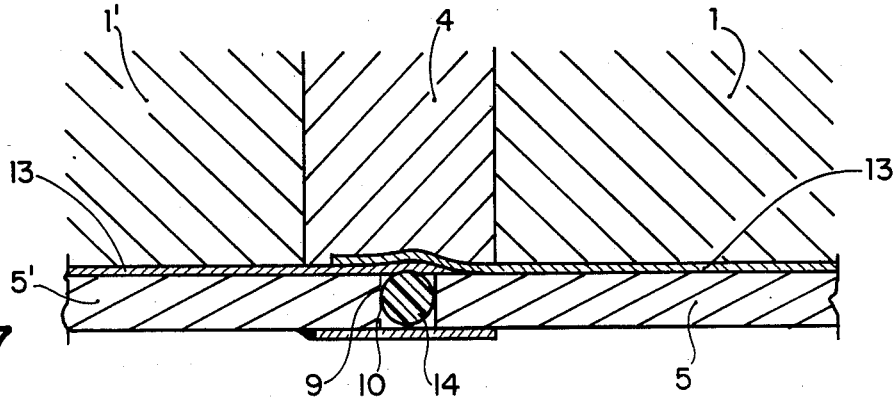

FIG. 7 shows another alternative embodiment of the gasket between the soles 5 and 5' of adjacent cathode blocks 1 and 1'. The direct weld between 5 and 5' is omitted, and a flexible gasket 14 which is preferably a conductor of electricity and compressible such as a graphite braid or a thin-walled metal tube (thickness less than half the thickness of the sole 5 or 5') resting freely between the strips 10A and 10B is placed in the clearance 9. Furthermore, during assembly, covering and sticking of the films of elastic carbonated material 13, which improves the seal of the gasket, can be provided for the above-mentioned purposes.

Figure 8:
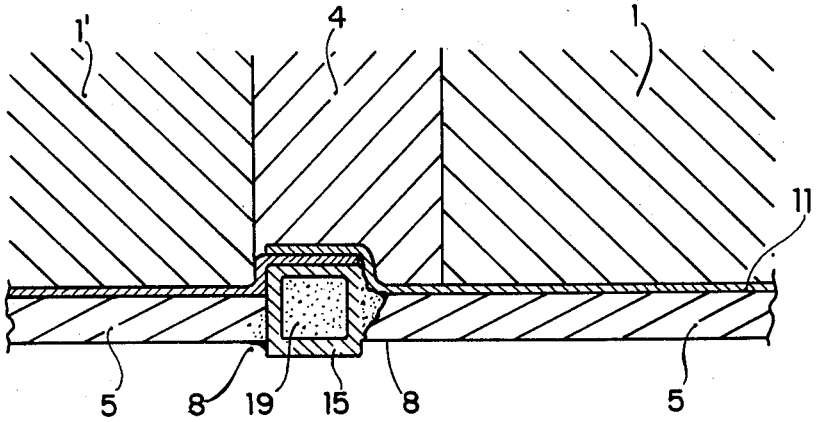

FIG. 8 shows another alternative in which the flexible carbonated gsket 14 is replaced by a deformable tube 15 which has previously been welded to at least one of the soles 5 or 5' which absorbs the effects of expansion and which can be filled with an inert powdered material 19 to limit the internal oxidation under heat.

Of course, flexible or deformable connections of this type can be used for the joint between the half screens of the same block if the block comprises a seal with steel half rods separated in the centre of the block by a space for expansion.

Figure 9:
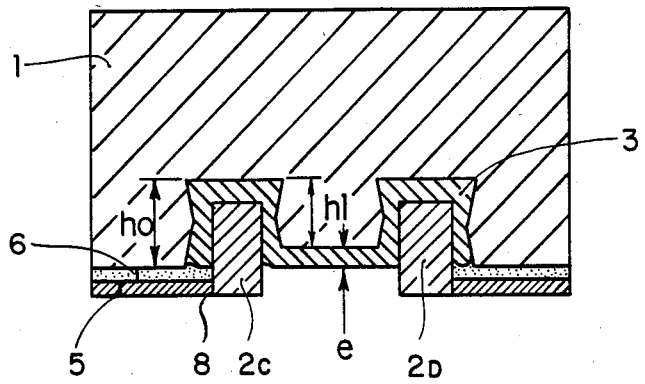
Figure 10:
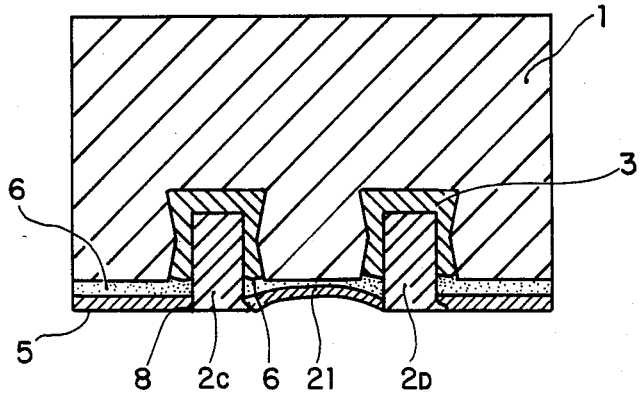

FIGS. 9 and 10 show the implementation of the invention in the case of carbonated blocks 1 provided with two parallel cathode rods 2C and 2D, an arrangement which is sometimes employed with the aim of increasing the contact surface with the carbonated block.

In FIG. 9, it appears that the two rods, 2C and 2D, have been sealed simultaneously by pouring cast iron 3, the thickness (e) of the plate of cast iron between the two rods preferably being less than or equal to the difference between the dimensions $h_o$ and $h_1$ ($e<h_o-h_1$).

The sole 6 can be made of mere steel sheet or mixed steel-copper sheet as described above.

In FIG. 10, the two cathode rods 2C, 2D have been sealed individually then connected by welding to a sheet 21 preshaped into an arc so as to obtain, under heat, a good electrical contact with the central portion of the carbonated block via the elastic conductive layer 6.

In all the cases illustrated (FIGS. 2–10), the metal sole is in contact with the base of the carbonated blocks, either directly or via the elastic material 6, over at least 20% of the surface of this base.

Figure 11:
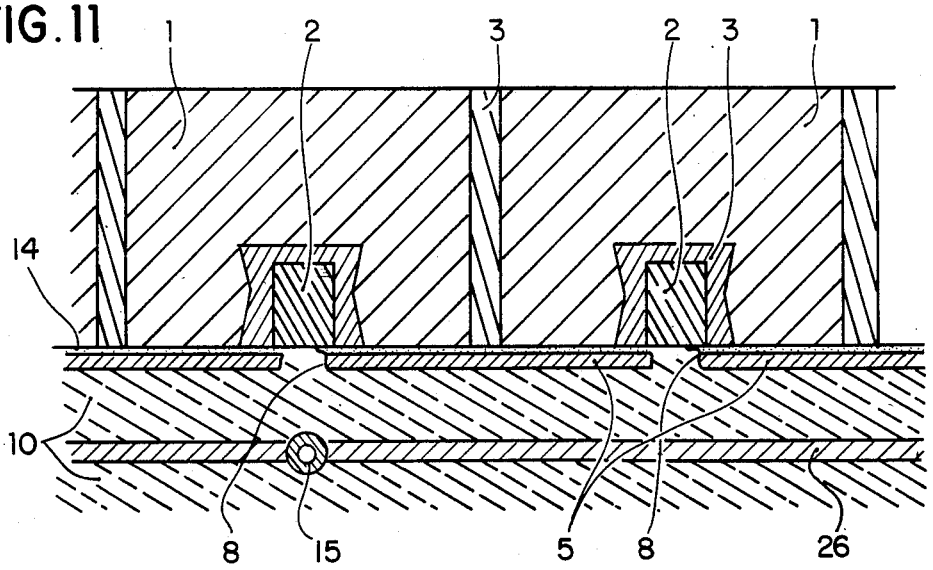

It is possible to improve the seal for the subcathode space and to eliminate almost completely the leakage of liquid aluminium and molten cryolite by arranging a screen 26 beneath the base of the carbonated blocks constituting the cathode of the electrolysis cell and in which the cathode rods are sealed, this screen extending at least over the entire space directly below the cathode (FIG. 11). It is constituted by at least one continuous steel sheet of which at least half of the surface area is constituted by a portion which is at least 5 mm and preferably 8–12 mm thick and comprises at least one deformable zone which absorbs the stresses due to the temperature deviations between the central portion situated directly below the cathode and the less hot peripheral portion. To avoid the risk of electro-chemical corrosion, it is therefore preferable to place the metal sole 5 in electrical contact with the screen 26.

The electrical connection between the sole 5 and the screen 26 can be provided by soldering, for example, with a continuous or discontinuous wire between at least one edge of the sole and the continuous screen. It can also be provided by melting a brazing alloy previously arranged between the sole and the continuous screen, the points of solidus and of liquidus of this alloy being suitably selected.

Figure 12:
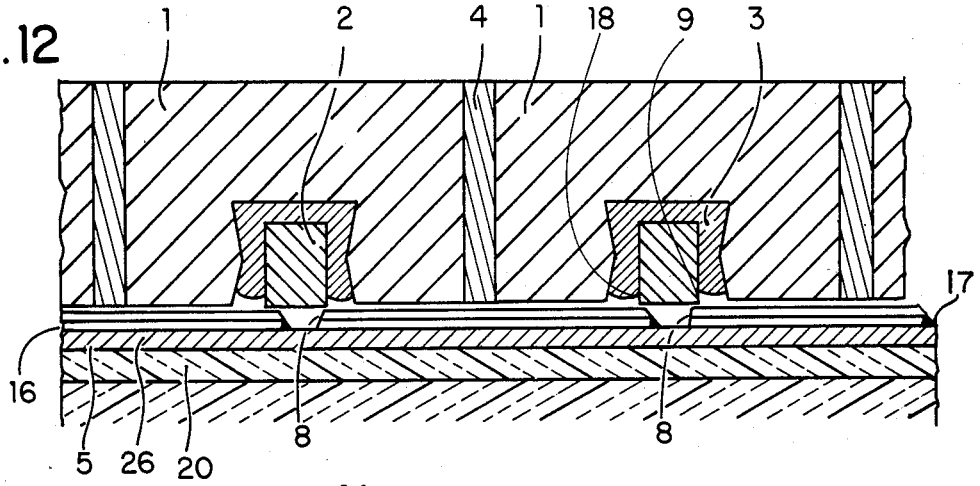

FIG. 12 shows an embodiment of this principle, according to which the sole 5 of each cathode rod 2 is placed directly on the thick steel continuous screen 26 to which it is connected by brazing 16 or by soldering 17.

The advantage of this arrangement is that the continuous thick steel screen 26 is at the electric potential of the cathode rods at all points, thus eliminating any effects of an electro-chemical cell which is a rapid corrosion generator. The screen is at least 5 mm and preferably between 8 and 12 mm thick. The sole 5 is at least 4 mm and preferably at least 10 mm thick.

FIG. 12 shows how the device can be positioned during construction of the cell. The cathode rod 2 has been positioned and sealed with cast iron 3 in each cathode block 1. A sole 5 of which the length is at least equal to and, in practice, slightly smaller than the distance between the axes of two successive rods is then soldered at 18. The block is then placed on the screen 26 resting on the insulating layer 20 and soldered at 9, preferably by a continuous wire so as to provide good electrical contact. The layers 24 and 25 are insulating and refractory bricks arranged on the bottom 27 of the electrolysis cell tank.

For installing the first and last block, it may be necessary to modify the length and arrangement of the soles to facilitate assembly.

It is possible to produce the electrical connection between the sole 5 and the screen 26 by brazing 16 using an alloy having a suitably selected point of solidus and point of liquidus, interposed between the sole and the screen.

This brazing alloy should meet the following conditions:

(1) Its solidus temperature (=highest temperature the alloy is solid) should be higher than approximately 600° C. and preferably 650° C. to allow, during first use of the cell, relative travel between the soles and the screen 26 produced by the differential expansion between the blocks and cathode rods provided with their soles and the continuous screen. If the braze is introduced in the form of a powdered bed or in very fine granules of alloy remaining solid up to about 650° C., this condition will be met.

(2) This same solidus temperature should preferably not exceed the temperature reached by the soles during continuous operation, that is to say approximately 850°–920° C. to permit the brazing alloy to liquefy at least partially while the temperature is being reached during start up of the cell. A welded joint is first produced by metallic interdiffusion between the steel sheets of the soles 5 and the screen 26 during this at least partial fusion of the intermediate alloy. This implies that:

at least one of the alloying elements is sufficiently soluble in iron in the solid state in a temperature range corresponding to the operating temperatures of the soles and the screen;

the iron is at least partially soluble in the liquid intermediate alloy so that the weld is effective after the alloying elements of the brazing filler have been absorbed by diffusion in the solid steel. In fact, superficial fusion of the steel is effected by the alloy, this alloy then disappearing by diffusion in the steel and leaving a solid weld in position.

(3) The alloy or one of its constituents should not assist oxidation of the steel.

(4) The alloy, or one of its constituents, should not render the steel mechanically or chemically brittle.

(5) Finally, for industrial use, the cost of this alloy should be moderate.

The optimum brazing compositions for carrying out the invention contain at least 50% of a first metal seleced from aluminium, copper, zinc, the remainder being at least one second metal selected from manganese, nickel, vanadium, beryllium, silicon, tin and titanium as well as aluminium and copper if the first metal is not copper or aluminium.

TABLE 1

| Examples | Alloy (% by weight) | | T. Solidus | T. Liquidus |
|---|---|---|---|---|
| 1 | Al = 83 ± 3% | Mn = 17 ± 3% | 659 to 822 | 822 to 880 |
| 2 | Al = 68 ± 3% | Ni = 32 ± 3% | 640 to 854 | 854 to 980 |
| 3 | Al = 97 ± 1% | V = 3 ± 1% | 662 to 735 | 750 to 950 |
| 4 | Al = 90 ± 2% | Fe = 10 ± 2% | 655 | 850 to 950 |
| 5 | Cu = 96.5 ± 1% | Be = 3.5 ± 1% | 866 | 866 to 950 |
| 6 | Cu = 65 ± 3% | Mn = 35 ± 3% | 870 | 870 |
| 7 | Cu = 75 ± 2% | Al = 25 ± 2% | 624 to 848 | 850 to 950 |
| 8 | Cu = 84 ± 2% | Si = 16 ± 2% | 802 | 802 to 860 |
| 9 | Cu = 80 ± 2% | Sn = 20 ± 2% | 798 | 798 to 920 |
| 10 | Cu = 76 ± 3% | Ti = 24 ± 3% | 880 | 880 to 892 |
| 11 | Zn = 60 ± 4% | Mn = 40 ± 4% | 750 to 835 | 835 to 960 |
| 12 | Zn = 71 ± 2% | Cu = 29 ± 2% | 700 | 700 to 810 |

Of these alloys, compositions numbers 1, 3, 6 and 7 are particularly suitable for industrial use. Some alloys are brittle and can be crushed to the desired fineness while others have to be treated in known manner by spraying in the liquid state.

If the composition of the alloy allows, the brazing filler can be used in the form of a thin laminated foil introduced between the sole and the screen during assembly. The presence among the main or secondary constituents of the alloy of a metal which has a reducing effect towards iron oxide (scale) which usually covers the steel plates used for forming the sole or the screen (metal such as Al and/or Si) makes it unnecessary to use any other descaling agents to assist the spreading of the brazing filler when it passes into the liquid state.

Figure 13:
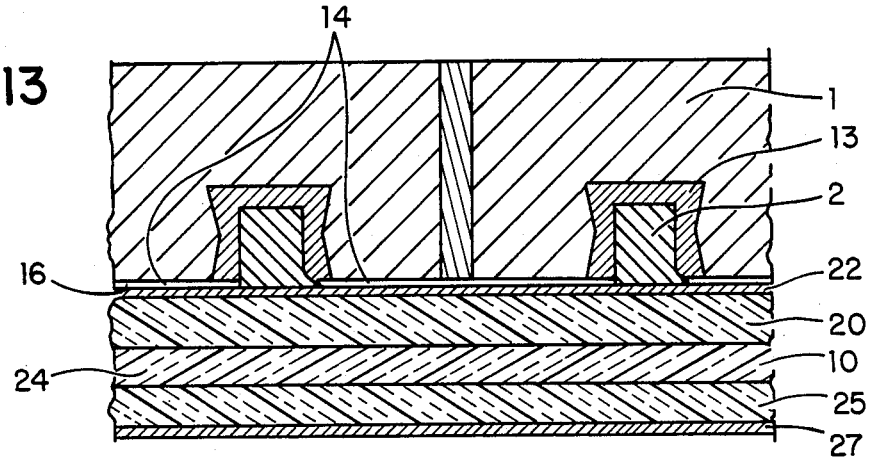
Figure 14:
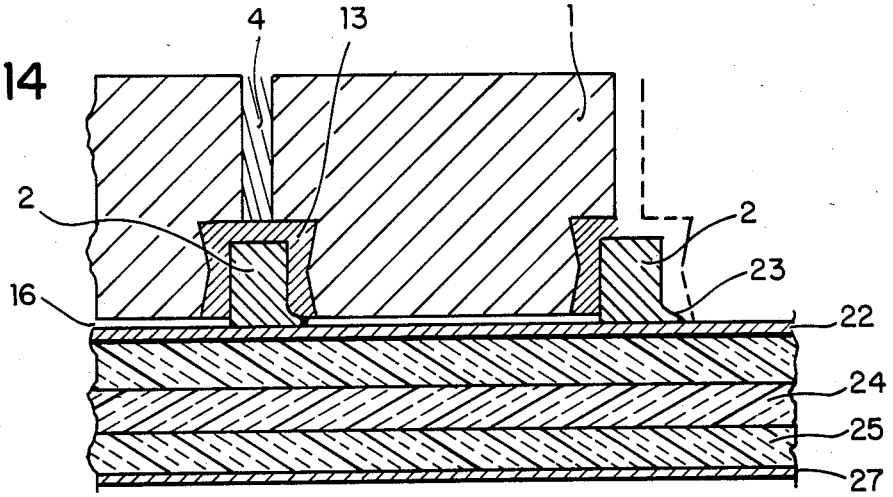

It is also possible, in a variation of the invention, to combine the sole 5 and the screen 26 in a single part constituted by a thick steel sheet 22, as shown in FIGS. 13 and 14, which can be provided with gaskets or deformable zones capable of withstanding thermal expansions, for example the tube 15 in FIG. 2. In such a case, the thickness of the screen can be between 10 and 20 mm.

For assembly, the rods 2 are positioned on the screen 22 then connected by a wire of solder 23. After this, the cathode blocks 1 are installed and are sealed by the carbonated paste 13. The connection can also be made by a brazing filler 16.

A layer of flexible material which is a good conductor of electricity, for example "PAPYEX" (trade mark registered by the Company "Le Carbone-Lorraine") which is a film of flexible graphite or the felt of graphite RVG produced by the same company can also be interposed between the carbonated blocks 1 and the thick screen 22.

FIG. 14 shows another method of assembly in which the cathode rods 2 are not arranged directly beneath the axis of block 1 but astride two adjacent blocks immediately beneath the gasket between these two blocks. The advantage of this arrangement is that the carbonated paste 4 which provides the seal between the blocks 1 and the rods 2 can be injected, hot, into the space separating two adjacent blocks.

Figure 15:
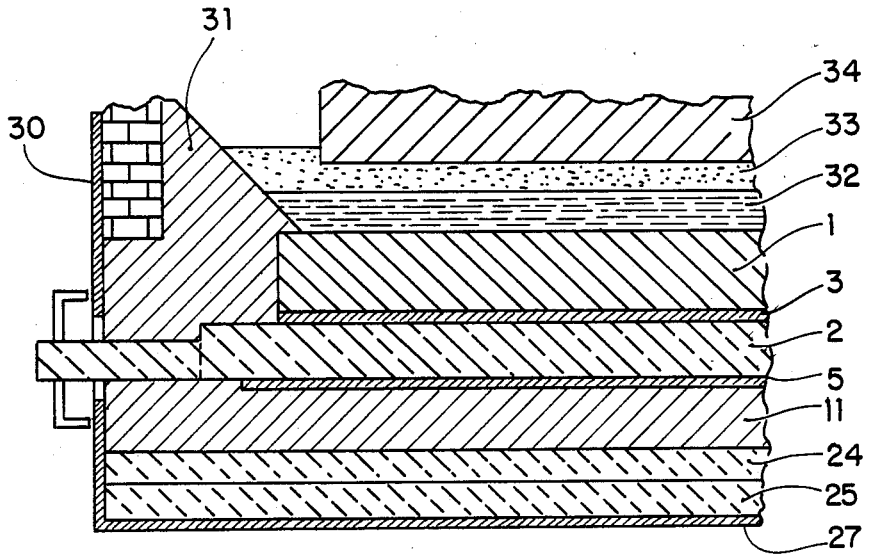

FIG. 15 shows very schematically the partial cross-section of an electrolysis cell according to the invention with the external metal tank 30, the lateral brasque 31 made of carbonated paste, the cathode carbonated block 1, topped by the layer of liquid aluminium 32, the electrolyte 33 and the anode system 34, the steel cathode rod 2 sealed with cast iron 3 and the steel sole 5 forming the subject of the invention. It will be noted that the cross-section of the cathode rod 2 is reduced as it passes through the external portion of the lining 31 and of the tank 30.

ADVANTAGES OBTAINED BY THE INVENTION

The following advantages are obtained by carrying out the invention:

(1) The metal sole on each cathode rod (one cell may have several tens of them) increases.by at least 10% and up to 20 to 50% the cross-section for the passage of cathode current and the steel-carbon contact surface with a corresponding reduction in the voltage drop at the steel carbon contact.

(2) The metal sole connected to the screen permits a very good distribution of the current over the entire surface of the cathode and hence a reduction in the horizontal currents in the liquid aluminium which have an undesirable influence on the stability and the yield of the cell owing to the effects of turbulence produced in the layer of liquid aluminium.

(3) The metal sole connected to the screen also permits excellent homogeneity in the temperature of the cathode assembly, thus reducing the risks of infiltration into the hot zones and of condensation in the relatively cooler zones.

(4) If a cathode rod is broken (by corrosion due to the infiltration of cryolite and liquid aluminium into the gaskets) the sole acts for the block which is considered as emergency collector, thus delaying the moment when the cell will have to be stopped and dismantled in order to remake the cathode. Moreover, the electric unbalance of the cell is limited and this is favourable for the Faraday yield during the period between breakage of a rod and stoppage of the cell.

The presence of the screen 26 contributes the following additional advantages:

(5) Blockage of all infiltrations of sodo-fluorinated products and of cryolite in the direction of the thermal insulation placed on the bottom of the tank, which are the main cause of break-down in electrolysis cells.

(6) Greater ease of construction of the cathode which, in the case shown in FIG. 3, for example, requires only a single wire of additional solder which is produced flat and in an accessible space, or one application of powdered brazing filler, in comparison with the earlier solutions.

(7) Elimination of the risk of electro-chemical corrosion of the screen as it is at the potential of the cathode rods at all points. Implementation of the invention helps to increase the useful life span of electrolysis cells and to maintain good thermal insulation of the bottom during the life span.

All these advantages are combined to increase significantly the service life of an electrolysis cell.

I claim:

1. A cathode rod permitting extraction of the current from a cell for the production of aluminium by electrolysis according to the Hall-Heroult process, which is sealed in at least one open groove 7 at the base of each of the carbonaceous blocks 1 forming the cathode of the electrolysis cell, characterised in that said cathode rod 2 is extended by a metal sole 5 in electrical contact with the base of the carbonaceous blocks 1 over at least 20% of the total surface area of this base, said metal soles being constituted by a metal sheet which is at least 4 mm thick and being welded to the cathode rod 2 before the carbonaceous blocks 1 are positioned in the cell.

2. A cathode rod according to claim 1, characterised in that the metal sole is made of sheet steel.

3. A cathode rod according to claim 1, characterised in that the soles 5 and 5' of two adjacent cathode blocks 1 and 1' are separated by a space 9 in such a way that they come into contact once they have reached their equilibrium temperature in operation, which is between about 800° and 900° C.

4. A cathode rod according to claim 1, characterised in that the soles 5 and 5' of two adjacent cathode blocks 1 and 1' are separated by a space 9 provided with a flexible gasket 14.

5. A cathode rod according to claim 3 or 4, characterised in that the space 9 is provided with blocking means such as 10A, 10B.

6. A cathode rod according to claim 1, characterised in that the lower face of the sole 5 is placed in a superimposed relationship and in electrical contact with a thick, continuous metal screen 26 arranged at the top of a thermally insulating lining 10.

7. A cathode rod according to claim 11, characterised in that the electrical connection between the sole 5 and the screen 26 is provided by soldering.

8. A cathode rod according to claim 7, characterised in that the soldered joint is obtained by a wire of continuous or discontinuous solder between at least one edge of the sole 5 and the screen 26.

9. A cathode rod according to claim 7, characterised in that the solder is provided by the melting of a brazing alloy previously placed between the sole and the continuous screen.

10. A cathode rod according to claim 9, characterised in that the brazing alloy has a point of solidus of between 600° and 920° C.

11. A cathode rod according to claim 19, characterised in that the brazing alloy contains at least 50% of a first metal selected from the group consisting of aluminium, copper and zinc, the remainder being at least one second metal selected from the group consisting of manganese, nickel, vanadium, beryllium, silicon, tin and titanium, as well as aluminium and copper if the first metal is not copper or aluminium.

12. A cathode rod according to claim 9, wherein said brazing alloy has a point of solidus of between 650° and 850° C.

13. A cathode rod according to claims 6 or 7, characterised in that the screen 26 comprises means such as 7 for absorbing thermal expansion and stresses.

14. A cathode rod according to claim 6, characterised, in that the sole 5 and the screen 26 are combined in a single plate 22 in direct contact with each cathode rod to which it is connected by welding or brazing and is provided with means such as 15 for absorbing the thermal expansion and stresses.

15. A cathode rod according to claim 14, characterised in that it is arranged directly below the axis of each cathode block 1.

16. A cathode rod according to claim 14, characterised in that a gasket is provided separating two adjacent cathode blocks and said cathode rod is arranged directly beneath the gasket.

17. A cathode rod according to claim 14, characterised in that it is sealed to the block 1 by a carbonaceous paste 4 which is subsequently baked in position.

18. A cathode rod permitting extraction of the current from a cell for the production of aluminium by electrolysis according to the Hall-Heroult process, which is sealed in at least one open groove 7 at the base of each of the carbonaceous blocks forming the cathode of the electrolysis cell, characterised in that said cathode rod 2 is extended by a metal sole in electrical contact with the base of the carbonaceous blocks 1 over at least 20% of the total surface area of this base, said sole 5 comprising an iron-copper composite material having the copper portion turned upwards, facing the base of the carbonaceous block, said sole being at least 4 mm thick, and being welded to the cathode rod 2 before the carbonaceous blocks 1 are positioned in the cell.

19. A cathode rod according to claim 18, characterised in that the thickness of the copper portion is at least 5% of the thickness of the steel portion.

20. A cathode rod permitting extraction of the current from a cell for the production of aluminium by electrolysis according to the Hall-Heroult process, which is sealed in at least one open groove 7 at the base of each of the carbonaceous blocks 1 forming the cathode of the electrolysis cell, characterised in that said cathode rod 2 is extended by a metal sole 5 in electrical contact with the base of the carbonaceous blocks 1 over at least 20% of the total surface area of this base, said sole comprising a metal sheet which is at least 4 mm thick and welded to the cathode rod 2 before the carbonaceous blocks 1 are positioned in the cell, said electrical contact between the sole 5 and the base of the carbonaceous blocks 1 being provided by at least one layer of elastic material 6 which is a conductor of electricity.

21. A cathode rod according to claim 20, characterised in that the elastic material 6 is a carbonaceous product selected from carbon felt, graphite felt, laminated graphite film and the laminated graphite film complexes adhered to a graphite or carbon felt.

22. A cathode rod according to claim 1, 18 or 20, wherein said metal sole 5 is at least 10 mm thick.

23. In a cell for the production of aluminium by electrolysis according to the Hall-Heroult process comprising a cathode formed of carbonaceous blocks, each of said blocks including at least one open groove in its base having a cathode rod sealed therein for extraction of the current from said cell, the improvement comprising extending said cathode rod by a metal sole in electrical contact with the base of said carbonaceous blocks over at least 20% of the surface area of said base, said sole comprising a metal sheet which is at least 4 mm thick and which is welded to the cathode rod before the carbonaecous blocks are positioned in the cell.

* * * * *